US011313141B2

(12) United States Patent
Vickers

(10) Patent No.: US 11,313,141 B2
(45) Date of Patent: Apr. 26, 2022

(54) TUBE FOR PREVENTING WATER FROM ENTERING A BASIN

(71) Applicant: P.V. Flood Control Corp., Calgary (CA)

(72) Inventor: Paul Vickers, Calgary (CA)

(73) Assignee: P.V. Flood Control Corp., Calgary (CA)

( * ) Notice: Subject to any disclaimer, the term of this patent is extended or adjusted under 35 U.S.C. 154(b) by 31 days.

(21) Appl. No.: 16/659,430

(22) Filed: Oct. 21, 2019

(65) Prior Publication Data

US 2021/0115688 A1 Apr. 22, 2021

(51) Int. Cl.
*E04H 4/10* (2006.01)

(52) U.S. Cl.
CPC ..... *E04H 4/103* (2013.01)

(58) Field of Classification Search
CPC ..... B65D 2590/046; B65D 2590/043; B65D 2590/04; F17C 2201/0185; F17C 2201/018; E04H 4/103; E04H 4/14
See application file for complete search history.

(56) References Cited

U.S. PATENT DOCUMENTS 3,167,209 A * 1/1965 Jones ..... B65D 90/046 383/22
4,879,772 A * 11/1989 Meloney, Jr. ..... E04H 4/06 4/506
6,626,312 B2 * 9/2003 Maturana ..... B65D 90/046 220/1.6
8,201,285 B1 6/2012 Pugliese et al.
8,562,212 B1 * 10/2013 Strickland ..... B65D 88/1681 383/61.3
8,568,546 B2 * 10/2013 Oropallo ..... E04H 4/106 156/66
8,627,980 B2 1/2014 Woodruff
2019/0368212 A1 12/2019 Greenwood

OTHER PUBLICATIONS

PCT International Search Report and Written Opinion, PCT Application No. PCT/IB2020/000846, dated Dec. 10, 2020, eight pages.

* cited by examiner

*Primary Examiner* — Janie M Loeppke
(74) *Attorney, Agent, or Firm* — Fenwick & West LLP

(57) ABSTRACT

A flexible and waterproof containment tube sits within a basin and prevents objects from entering the basin. When placed inside the basin, the containment tube is filled with a filling fluid. The dimensions of the containment tube are similar to that of the basin such that the containment tube fits within and fills substantially all of the basin. The outward hoop stress of the side portion against the walls of the basin evenly distribute pressure and protect the basin from damage, such as debris, rain or flood, water, or other objects.

20 Claims, 5 Drawing Sheets

TUBE FOR PREVENTING WATER FROM ENTERING A BASIN

BACKGROUND

Basins need a temporary means for protecting them while not in use. Basins include swimming pools, fracking pools, above-ground tanks, in-ground tanks, and other means for containing relatively large quantities of fluids. When empty, basins can be subjected to various forms of damage, such as damage from debris, rain damage, flooding damage, and other natural disaster damage. Additionally, it is desirable to prevent humans and animals from accidentally falling into the basin when not in use.

Conventional methods, such as covers and liners, have a number of drawbacks. For example, conventional covers are often not strong enough to support the weight of an animal, such as a deer, or a child, or are otherwise made out of strong material that is expensive. Additionally, covers and liners offer little protection from flood damage or other natural disasters. A superior and more cost-efficient means of protecting basins is necessary.

SUMMARY

A containment tube designed to fit within the dimensions of the basin is filled with a filling fluid and sits within the otherwise empty basin. The containment tube is made of a flexible and water-tight material and has a valve for filling and a valve for draining. When not filled, the containment tube can be rolled up and stored conveniently. When filled with a filling fluid, such as water or air, the containment tube takes the shape of the basin and sits within the basin to prevent unwanted debris, animals, and other items or living beings from entering the basin or contaminating the containment fluid. The filled containment tube may also prevent damage to the basin. The filled containment tube fits snugly within the walls of the basin and re-distributes force evenly via hoop stress. In some embodiments, the containment tube has a zipper for ease of access to the interior of the tube for inspection or cleaning. Some embodiments include an exterior protective liner for protecting the containment tube from puncture.

The filled containment tube prevents objects from entering the basin. For example, the filled containment tube can support the weight of a small animal or child by re-distributing the weight throughout the tube, there preventing accidental injuries. Similarly, the containment tube protects the basin from damage by debris by inhibiting the debris from coming in contact with the basin, since the containment tube fills the interior of the basin. The containment tube also prevents unwanted fluid from filling and damaging the basin, such as flood damage or rain damage, because the unwanted fluid cannot enter water-tight containment tube nor can it seep through the contact between the water-tight containment tube and the walls of the basin. The containment tube can be manufactured to fit basins of different shapes and sizes in a relatively cost-effective manner. Additionally, the containment tube can be easily assembled and filled, and easily drained and put away for storage.

DETAILED DESCRIPTION

The Figures (FIG.) and the following description relate to preferred embodiments by way of illustration only. It should be noted that from the following discussion, alternative embodiments of the structures and methods disclosed herein will be readily recognized as viable alternatives that may be employed without departing from the principles of the embodiments.

Reference will now be made in detail to several embodiments, examples of which are illustrated in the accompanying figures. It is noted that wherever practicable, similar or like reference numbers may be used in the figures and may indicate similar or like functionality. The figures depict embodiments for purposes of illustration only.

Overview

A containment tube is water-tight and does not have any open sides. The containment tube is configured to receive a filling fluid, such as any liquid substance, such as water, wet concrete, other fluid, or even an expanding and hardening foam (such as polyurethane foam) or gas in certain configurations, which may be pumped into the tube. The containment tube is constructed from a waterproof and flexible material, such as vinyl-coated polyester, polyvisqueen or other material that prevents intrusion of fluid through its surface. In an embodiment, the polyvisqueen is between 5-15 millimeters in thickness. In some embodiments, the polyvisqueen is reinforced, for example, with an embedded webbing material such as nylon strands (e.g., string). The edges between pieces of water-tight material can be sealed together by at a seam using glue, pressing, wedge welding, or another sealing method.

A basin is a concave structure with an enclosed bottom and sides for holding a fluid and an open top, such as, swimming pools, fracking pools, above-ground tanks, in-ground tanks, and other means for containing relatively large quantities of fluids. The basin has a cross-sectional area and shape for both the bottom of the basin and the top opening of the basin. Some basins may have the same cross-sectional area and shape from the bottom to the top opening, whereas other basins may have different shape or size cross-section at one end. The basin also has a depth, which is the distance from the top opening of the basin to the bottom of the basin.

Example Containment Tube Assembly and Structure

Figure 1A:
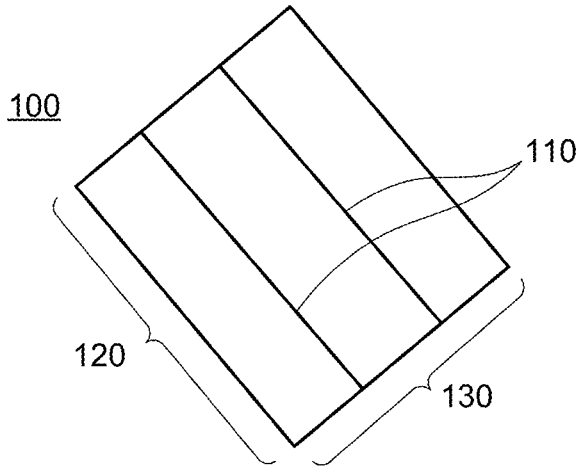
FIGS. 1A-1C show a schematic of a process of manufacture of a top portion or a base portion of a containment tube in accordance with one embodiment.
Figure 1B:
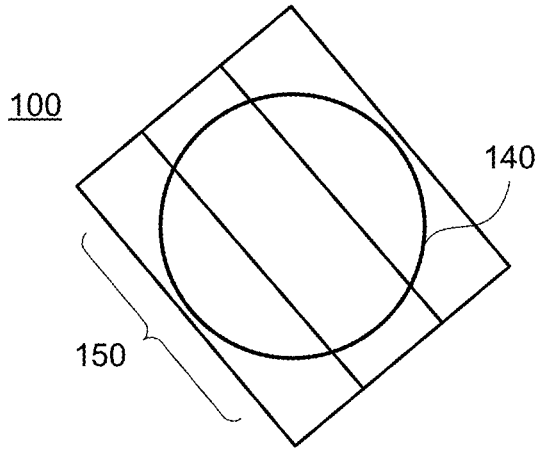
Figure 1C:
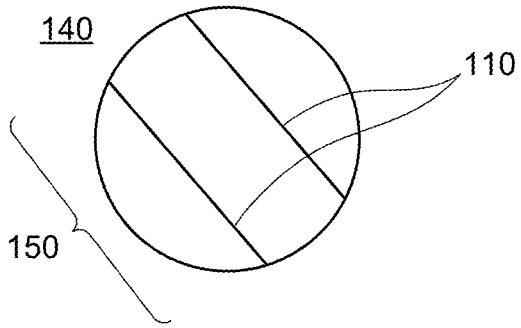

FIGS. 1A-1C show a schematic of a process of manufacture of a top portion or a base portion of a containment tube. For simplicity, this section primarily refers to the portion as the top portion. The process of manufacture is used to construct the necessary base portion of the containment tube as well, as described in greater detail below.

FIG. 1A shows a schematic of a sheet 100 of flexible, waterproof material. The sheet 100 has a length of 120 and a width of 130, which are greater than or equal to the dimensions of the cross-section of the top opening of the basin (or the cross-section of the bottom of the basin, if in relation to the base portion). The sheet 100 may be assembled piecewise to be the desired dimensions by sealing seams 110 from multiple pieces of flexible, waterproof material. Piecewise assembly of the sheet 100 enables less material to be wasted, thereby keeping costs down, while maintaining the water-tight properties desired.

FIG. 1B shows a schematic of a sheet of 100 overlaid with an outline of a top portion 140. The size and shape of the top portion 140 is determined based on the cross-sectional area of the top opening of the basin. The top portion 140 is substantially the same as the cross-sectional area of the top opening of the basin. The top portion 140 has a size dimensions slightly less than the size dimensions of the cross-sectional area of the top opening of the basin, such that the top portion of the containment tube will fit within and span substantially all of the cross-sectional area of the top opening of the basin (see FIG. 4 for an example). For example, the schematic of the top portion 140 depicted in FIG. 1B is circular in shape with a diameter 150, and thereby is for a basin that has a cross-sectional top opening that is also circular in shape and has a diameter slightly greater than the diameter 150. While the embodiment depicted in FIGS. 1B and 1C show a circular top portion intended for a circular cross-sectional top opening, it should be noted that the top portion and corresponding cross-sectional top opening can be any shape, including but not limited to an oval, a triangle, a square, a rectangle, or a trapezoid.

FIG. 1C shows a schematic of the top portion 140. The top portion 140 depicted in FIG. 1C is the top portion 140 of FIG. 1B that has been cut out from the sheet 100. The top portion 140 has the sealed seams 110 of the larger sheet 100 and is waterproof and flexible even with the sealed seams 110.

Because the containment tube has both a top portion and a bottom portion, the above process of manufacture must either be performed to produce both portions. In some embodiments, the process of manufacture is repeated to produce a second portion. In one embodiment, the process of manufacture is repeated with different cross-sectional areas or shapes, if the basin requires such in order for the containment tube to fit snugly. For example, a basin may be a pool with sides that slope inwards towards the bottom of the pool. Accordingly, the top portion will be of a larger size than the base portion. In another embodiment, where the top portion and the base portion are the same shape and size, both portions can be manufactured simultaneously by layering two sheets of waterproof material for cutting.

In some embodiments, the top portion has a first valve for filling the containment tube with a fluid. Similarly, in some embodiments, the top portion has a second valve for draining the fluid contained within the containment tube. Example fluid filling or draining apparatuses to attach to the valves may include a pump or hose or pipe, which may be supplied with fluid by a pump or gravity, and in the case of gas, a pressurized canister or compressor. In some embodiments, the top or bottom portion has a zipper for inspecting or cleaning the inside of the containment tube. These features can be added to the top and/or bottom portion after the stage of assembly shown in FIG. 1C.

Figure 2A:
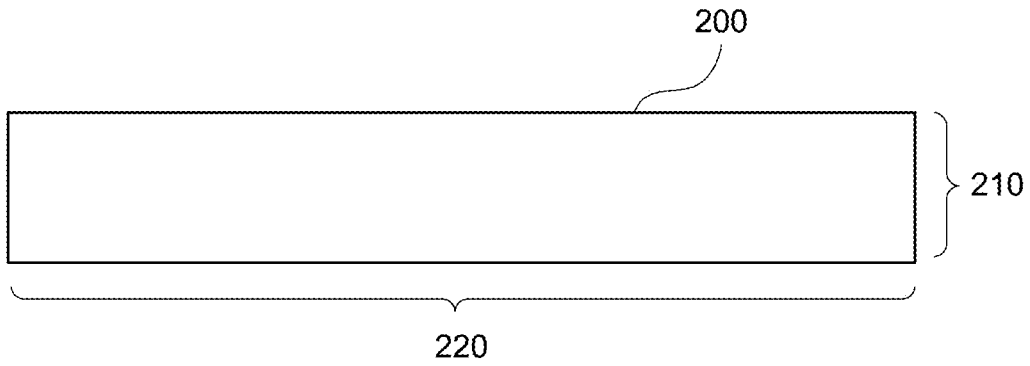
FIGS. 2A-2B show a schematic of a process of manufacture of a side portion of the containment tube in accordance with one embodiment.
Figure 2B:
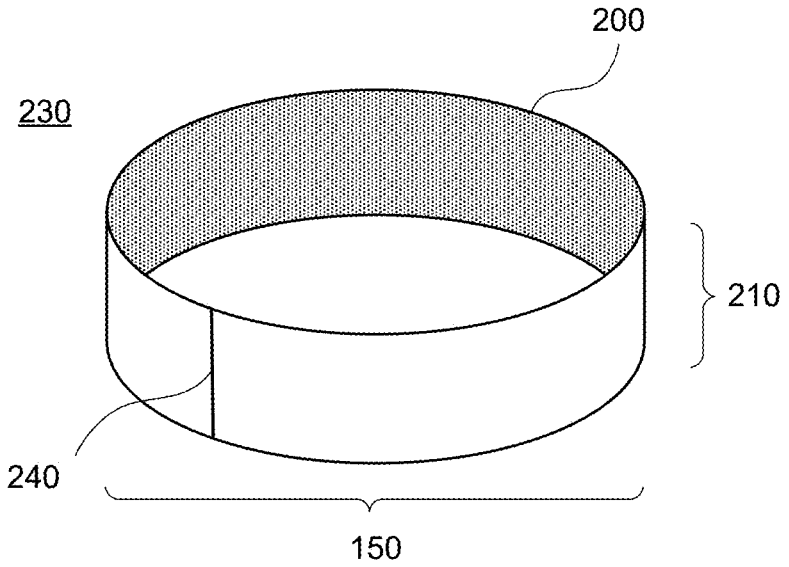

FIGS. 2A-2B show a schematic of a process of manufacture of a side portion 230 of the containment tube. FIG. 2A shows a schematic of a two-dimensional view of a sheet 200 to be constructed into the side portion 230. The sheet 200 is a made of a waterproof, flexible material, such as those previously discussed in the overview section and in relation to FIG. 1A. The sheet 200 has a height 210 and a width 220. The height 210 and width 220 of the sheet 200 are determined dependent upon the dimensions of the basin. The height 210 is determined to be slightly less than or equal to the depth of the basin, such that when assembled, the containment tube fits within the basin. The length 220 is described in relation to FIG. 2B.

FIG. 2B shows a schematic of a three-dimensional construction of the sheet 200 into the side portion 230. To form the side portion 230, the sheet 200 is positioned such that the height-wise edges are overlapped and sealed 240. Thereby, the length 220 of the sheet 200 must be long enough that the sheet 200 can create the seal 240 and fit substantially within the basin while making contact with the walls of the basin. In practice, the length 220 of the sheet 200 may be equal to or slightly longer than the perimeter (or largest perimeter) of the basin, depending on the width of the overlap formed for the seal. Alternately, the length 220 can be described as that, when sealed 240, the perimeter of the side portion 230 is the same as the perimeter of the top portion and the bottom portion (or the greater of the two if the top portion and bottom portion have different perimeters). For example, as shown in FIG. 2B, the side portion has the same diameter 150 as the top portion 140 of FIGS. 1B-1C.

In some embodiments, side portion 230 may be assembled piecewise. That is, multiple pieces of flexible, waterproof material may be assembled piecewise with waterproof seams to achieve the desired height 210 and width 220 of the sheet 200. In some embodiments, the piecewise assembly of the sheet 200 is similar to that of the sheet 100 of FIGS. 1A-1C. Additionally, after the side portion 230 is assembled from the sheet 200, the height of the side portion 230 can be increased by stacking a second assembled side portion 230 on top and attaching with a waterproof seam around the circumference of the two side portions 230.

Figure 3A:
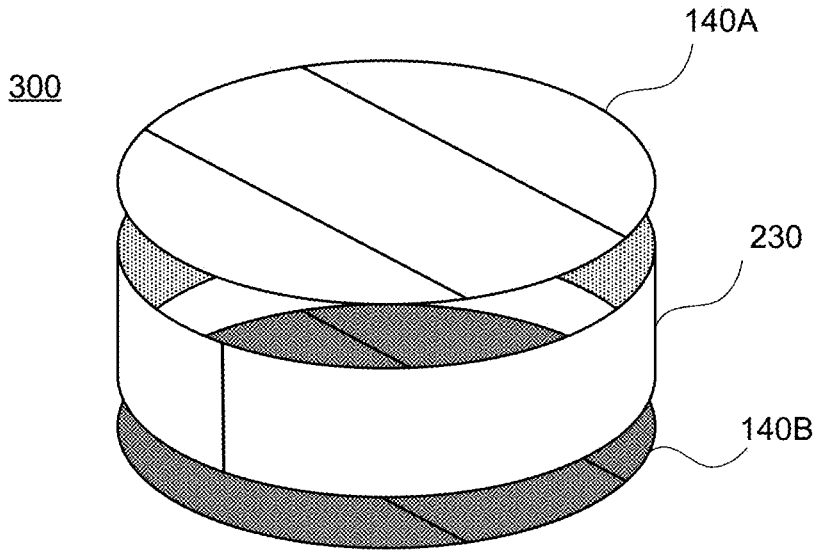
FIGS. 3A-3B show a schematic of a process of assembly of a containment tube, including the top portion, the base portion, and the side portion in accordance with one embodiment.
Figure 3B:
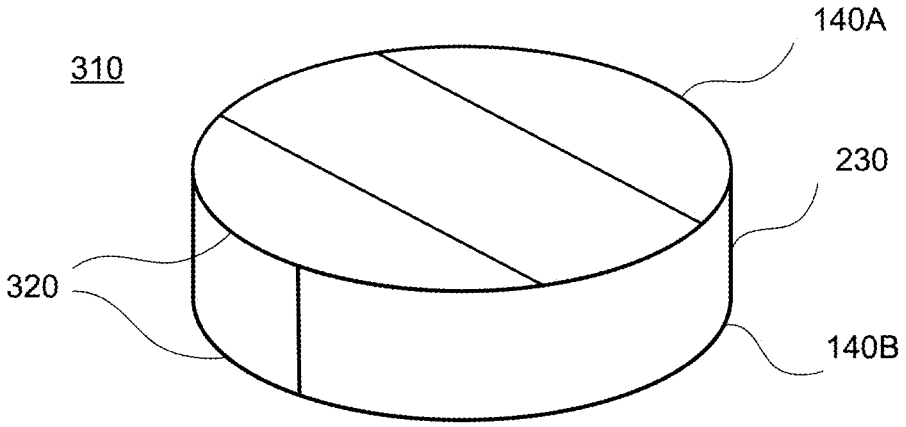

FIGS. 3A-3B show a schematic of a process of assembly of a containment tube 320, including the top portion 140*a*, the base portion 140*b*, and the side portion 230. The top portion 140*a* and the bottom portion 140*b* refer to two physically distinct portions assembled by the process described in relation to FIGS. 1A-1C.

FIG. 3A shows an alignment 300 of the top portion 140*a*, the base portion 140*b*, and the side portion 230. The top portion 140*a* is aligned above one opening of the side portion 230 and the bottom portion 140*b* is aligned below another opening of the side portion 230, opposite the top portion 140*a*.

FIG. 3B shows the containment tube 320 constructed when the top portion 140*a* and the bottom portion 140*b* have been attached to the side portion 230. The top portion 140*a* and the bottom portion 140*b* are attached to the edges of the side portion 230 by the seals 320 in accordance with the alignment 300 shown in FIG. 3A. The seals 320 are water-tight. In some embodiments, the seals 320 are air-tight. The seals 320 may be formed by the methods as described in the overview.

In one embodiment, after assembly of the containment tube 320, the containment tube 320 may be put through various tests prior to use in the basin. For example, the containment tube 320 may be filled with a filling fluid to check that the seals 320 are strong and not leaking. To test for water-tightness of the seals, the containment tube 320 is filled with water or another liquid. To test for air-tightness of the seals, the containment tube is filled with air or another gas.

Figure 4:
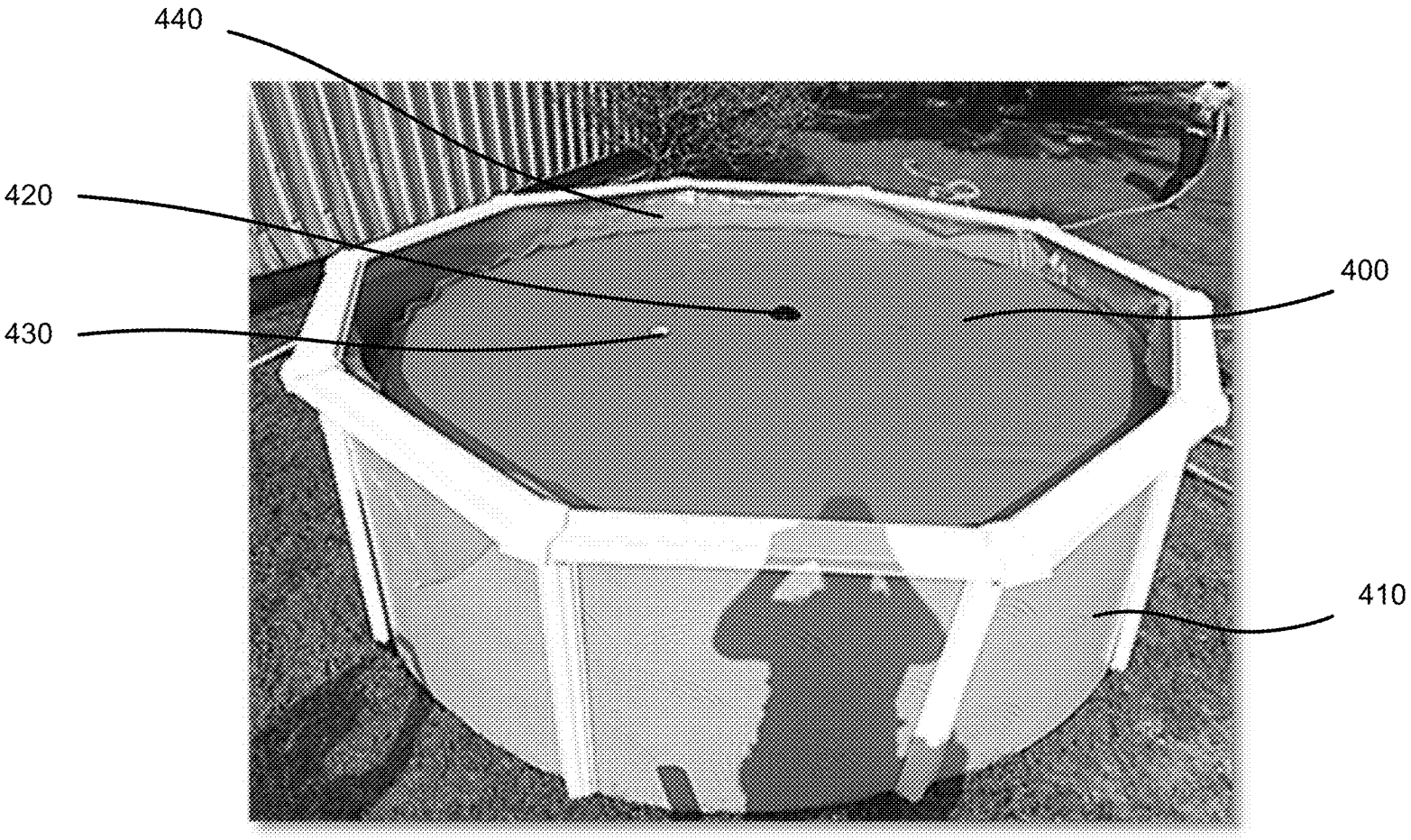
FIG. 4 shows an example of a filled containment tube sitting within a basin in accordance with one embodiment.

FIG. 4 shows an example of a filled containment tube 400 sitting within a basin 410. The containment tube 400 may be the same or similar to the containment tube 320. As depicted in FIG. 4, the basin 410 is an above-ground swimming pool with a circular cross-section top opening and bottom. The containment tube 400 has a circular top portion that fits within and spans substantially all of a cross-sectional top opening of the basin 410. That is, the containment tube 400 sits within the basin 410 such that the side-portions of the containment tube 400 are in contact with the side walls of the basin 410, and the top and bottom portions of the containment tube 400 are sealed to the side portion and may or may not be in direct contact with the walls of the basin 410. Thereby, the seals between the side portion and the top portion enable the containment tube 400 to span the entirety of the opening of the basin 410 and prohibit any objects from entering the basin 410. Hence, while the top portion itself may or may not span the entirety of the cross-sectional top opening of the basin 410, the top portion spans substantially all of the top opening to enable sealing with the side portion and enable containment tube 400 to prohibit entrance of objects into the basin 410. While the basin 410 and the containment tube 400 are both circular in cross-sectional shape in the embodiment shown in FIG. 4, the basin 410 and the containment tube 400 can take on other cross-sectional shapes, including but not limited to oval, triangular, square, rectangular, or trapezoidal.

The top portion of the containment tube 400 has a first valve 420 and a second valve 430. The first valve 420 is configured for receiving a filling fluid. The second valve 430 is configured for draining the filling fluid. In some embodiments, the containment tube 400 may have only one valve which is configured to both receive and drain a filling fluid. In other embodiments the first valve 420 or the second valve 430 may be located elsewhere on the containment tube such as the side portion or the bottom portion.

In some embodiments there is a protective sleeve between the containment tube 400 and the basin 410, as shown by protective sleeve 440. The protective sleeve is a flexible material, such as nylon. The protective sleeve protects the containment tube 400 from puncture, wear, or other damage that may be caused by the interior of the basin 410. The damage could be cause by sharp edges or imperfections in the walls or bottom of the basin 410, or be debris that had fallen into the basin 410 prior to the insertion of the containment tube 400. In one embodiment, the protective sleeve covers the side portion of the containment tube 400. In another embodiment, the protective sleeve covers the bottom portion of the containment tube 400. In another embodiment, the protective sleeve covers both the side portion and the bottom portion of the containment tube 400.

Figure 5:
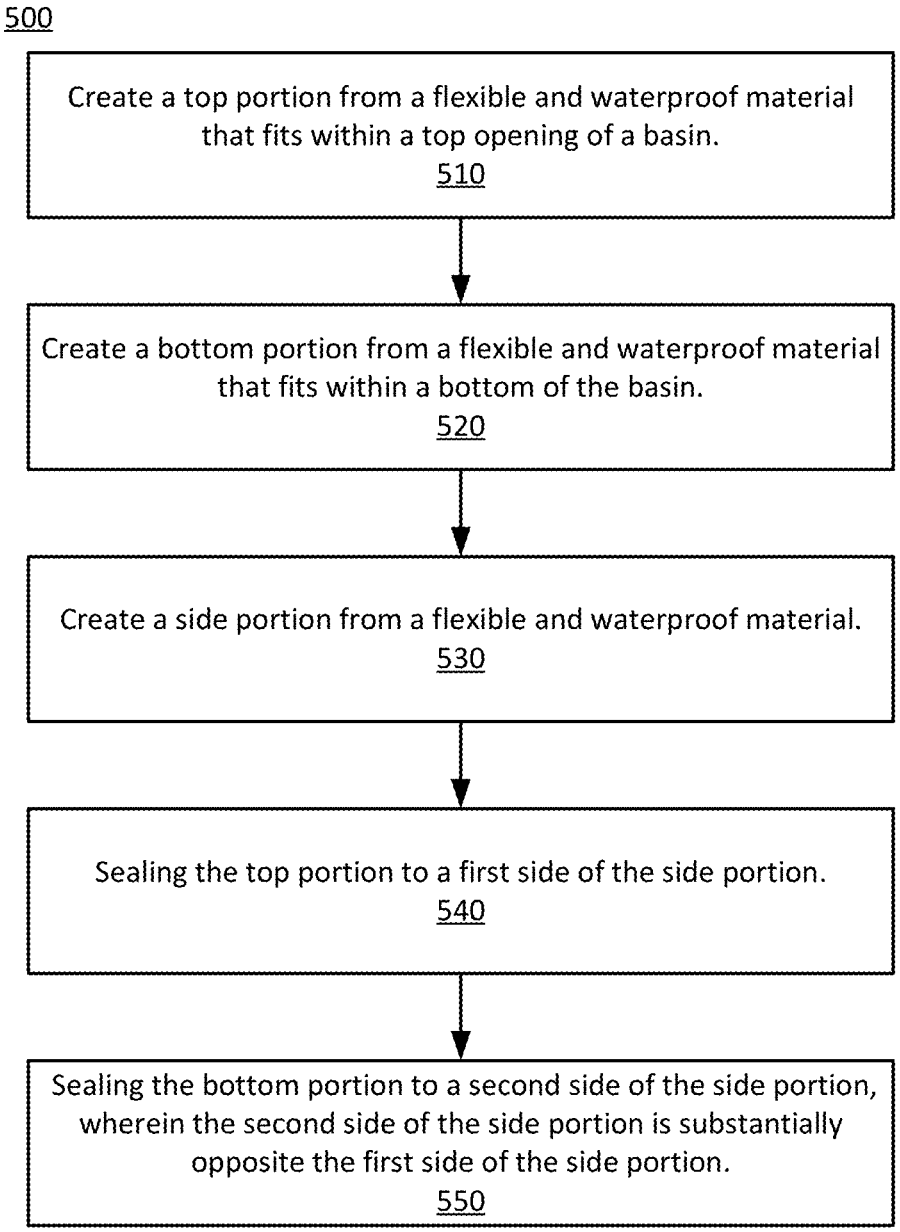
FIG. 5 is a flowchart of a process for assembling a containment tube in accordance with one embodiment.

FIG. 5 is a flowchart of a process 500 for creating a containment tube. A top portion is created 510 from a flexible and waterproof material, the top portion fits within a top opening of a basin. A bottom portion is created 520 from a flexible and waterproof material, the bottom portion fits within a bottom of the basin. A side portion is created 530 from a flexible and waterproof material. The top portion is sealed 540 to a first side of the side portion. The bottom portion is sealed 550 to a second side of the side portion, wherein the second side of the side portion is substantially opposite the first side of the side portion. Substantially opposite refers to the top portion and the bottom portion being opposite one another, though not necessarily parallel, and separated by the side portion.

Additional Considerations

Upon reading this disclosure, those of ordinary skill in the art will appreciate still additional alternative structural and functional designs through the disclosed principles of the embodiments. Thus, while particular embodiments and applications have been illustrated and described, it is to be understood that the embodiments are not limited to the precise construction and components disclosed herein and that various modifications, changes and variations which will be apparent to those skilled in the art may be made in the arrangement, operation and details of the method and apparatus disclosed herein without departing from the spirit and scope as defined in the appended claims.

What is claimed is:

1. An apparatus for preventing a fluid from entering a basin, the apparatus comprising:

a containment tube configured to fit within the basin and receive a filling fluid, further comprising:

a top portion that fits within and spans substantially all of a cross-section of an opening of the basin, the top portion assembled piecewise from a plurality of pieces of material and having waterproof seams that connect the plurality of pieces of material;

a base portion that fits within and spans substantially all of a cross-section of a bottom of the basin; and a side portion that connects the top portion and the base portion, wherein a part of the side-portion is in contact with part of one or more walls of the basin, wherein the top portion is sealed to one edge of the side portion and the base portion is sealed to a second side of the side portion, and wherein force applied to the top portion is re-distributed evenly when the containment tube is within the basin and filled by the filling fluid;

wherein the containment tube is water-tight.

2. The apparatus of claim 1 further comprising a protective sleeve that encompasses the side-portion of the water-tight containment tube, wherein the protective sleeve provides a protective barrier between one or more inner walls of the basin and the water tight containment tube.

3. The apparatus of claim 2, wherein the protective sleeve is comprised of a water-tight material.

4. The apparatus of claim 1 further comprising a protective sleeve that encompasses the bottom portion of the water-tight containment tube, wherein the protective sleeve provides a protective barrier between one or more inner walls of the basin and the water tight containment tube.

5. The apparatus of claim 4, wherein the protective sleeve is comprised of a water-tight material.

6. The apparatus of claim 1, wherein the top portion comprises a first valve configured to receive the filling fluid.

7. The apparatus of claim 6, wherein the top portion comprises a second valve configured for draining the filling fluid.

8. The apparatus of claim 1, wherein the top portion comprises a water-tight zipper for opening the water-tight containment tube for cleaning.

9. The apparatus of claim 1, wherein the top portion and base portion are circular and the containment tube is cylindrical in shape when filled with the filling fluid.

10. The apparatus of claim 1, wherein the basin is an empty fracking pool.

11. The apparatus of claim 1, wherein the basin is an empty swimming pool.

12. A method for creating a containment tube, the method comprising:

creating a top portion from a first flexible and waterproof material that fits within and spans substantially all of a cross-section of an opening of a basin, the top portion assembled piecewise from a plurality of pieces of material and having waterproof seams that connect the plurality of pieces of material;

creating a bottom portion from a second flexible and waterproof material that fits within and spans substantially all of a cross-section of a bottom of the basin;

creating a side portion from a third flexible and waterproof material;

sealing the top portion to a first side of the side portion; and sealing the bottom portion to a second side of the side portion, wherein the second side of the side portion is substantially opposite the first side of the side portion, and wherein force applied to the top portion is redistributed evenly when the containment tube is within the basin and filled by the filling fluid.

13. The method of claim 12, further comprising:

placing the containment tube within the basin;

filling the containment tube with a filling fluid, such that some of the side-portion is in contact with part of one or more walls of the basin.

14. The method of claim 13, further comprising:

filling the containment tube with a filling fluid prior to placing the containment tube within the basin;

testing the seals for leaks; and draining the containment tube, wholly or partially.

15. The method of claim 13, further comprising:

encompassing the side portion of the containment tube in a protective sleeve to provide a protective barrier between one or more inner walls of the basin and the water tight containment tube.

16. The method of claim 13, further comprising:

encompassing the bottom portion of the containment tube in a protective sleeve to provide a protective barrier between one or more inner walls of the basin and the water tight containment tube.

17. The method of claim 12, wherein creating the top portion, creating the bottom portion, or creating the side portion further comprises:

cutting the portion out of a sheet of flexible and waterproof material.

18. The method of claim 12, wherein the top portion further comprises:

a first valve, the first valve configured for receiving the filling fluid; and a second valve, the second valve configured for draining the filling fluid.

19. The method of claim 12, wherein the first flexible and waterproof material, the second flexible and waterproof material, and the third flexible and waterproof material are the same flexible and waterproof material.

20. The method of claim 12, wherein the top portion comprises a water-tight zipper for opening the water-tight containment tube for cleaning.

* * * * *